US007789767B2

(12) United States Patent
Lindsay

(10) Patent No.: US 7,789,767 B2
(45) Date of Patent: Sep. 7, 2010

(54) METHODS AND SYSTEMS FOR PUTTING ANALYSIS

(76) Inventor: Norman Matheson Lindsay, 19 Batchelors Way, Amersham, Buckinghamshire, HP (GB) HP7 9AH ( * ) Notice: Subject to any disclaimer, the term of this patent is extended or adjusted under 35 U.S.C. 154(b) by 324 days.

(21) Appl. No.: 11/912,956

(22) PCT Filed: May 2, 2006

(86) PCT No.: PCT/GB2006/001600

§ 371 (c)(1),
(2), (4) Date: Oct. 29, 2007

(87) PCT Pub. No.: WO2006/117547

PCT Pub. Date: Nov. 9, 2006

(65) Prior Publication Data

US 2008/0102972 A1 May 1, 2008

(30) Foreign Application Priority Data

Apr. 30, 2005 (GB) ..... 0508915.6

(51) Int. Cl.
*A63B 53/06* (2006.01)

(52) U.S. Cl. ..... 473/251; 473/409; 473/407; 473/155; 473/150; 473/222

(58) Field of Classification Search ..... 473/251, 473/409, 192, 407, 150, 151, 152, 153, 154, 473/155, 156, 140, 136, 222, 221; 700/91
See application file for complete search history.

(56) References Cited

U.S. PATENT DOCUMENTS 4,251,077 A 2/1981 Pelz et al.
5,398,936 A 3/1995 Kluttz et al.
5,412,345 A 5/1995 Brilka
5,413,345 A 5/1995 Nauck
5,472,205 A * 12/1995 Bouton ..... 473/222
5,733,200 A 3/1998 Kim
5,846,139 A * 12/1998 Bair et al. ..... 473/156
6,059,672 A 5/2000 Zeiner-Gundersen
6,095,928 A 8/2000 Goszyk (Continued)

FOREIGN PATENT DOCUMENTS

GB 2419298 A 4/2006

(Continued)

*Primary Examiner*—Gene Kim
*Assistant Examiner*—Matthew B Stanczak
(74) *Attorney, Agent, or Firm*—Davis & Bujold, P.L.L.C.

(57) ABSTRACT

Analysis of a golfer's putting stroke towards a target-hole (2) is derived by an analyzer (12;50) from sensor-signals representative of initial ball-speed and direction, using accumulated sets of historical putting-data, each set of historical data including initial putted ball-speed and direction and the resultant ball-speed and direction in approach to the target-hole (2), together with representation of whether the putt was successful. Initial ball-speed and direction is sensed by opto-electronic sensors (45) responding to back-reflection of infrared beams (13) from retro-reflectors (22-26) on the putted ball (1;20;52), or, is using retro-reflectors (71-73; 77,75) on the putter (3;51;70;74). Resultant ball-speed and direction in approach to the target-hole (2), and whether the putt is successful, is sensed by a monitor (7) from infrared beams (8-10).

20 Claims, 6 Drawing Sheets

U.S. PATENT DOCUMENTS

| | | | | |
|---|---|---|---|---|
| 6,540,620 | B1 | 4/2003 | Consiglio | |
| 6,569,027 | B2 * | 5/2003 | Florian | 473/160 |
| 6,702,690 | B1 | 3/2004 | Albright | |
| 6,842,232 | B2 * | 1/2005 | Miremadi | 356/5.01 |
| 2001/0017347 | A1 * | 8/2001 | Blankenship | 250/221 |
| 2002/0091008 | A1 | 7/2002 | Lee et al. | |
| 2002/0173365 | A1 | 11/2002 | Boscha | |
| 2003/0166420 | A1 | 9/2003 | Chou | |
| 2003/0207718 | A1 * | 11/2003 | Perlmutter | 473/221 |
| 2004/0127304 | A1 * | 7/2004 | Plank, Jr. | 473/221 |
| 2005/0202889 | A1 * | 9/2005 | Otten et al. | 473/151 |

FOREIGN PATENT DOCUMENTS

| | | |
|---|---|---|
| JP | 07-265481 | 10/1995 |
| JP | 2000/102633 A | 4/2000 |
| WO | 92/10248 | 5/1992 |
| WO | 2005/025681 A2 | 3/2005 |
| WO | 2005/081014 A1 | 9/2005 |

* cited by examiner

METHODS AND SYSTEMS FOR PUTTING ANALYSIS

This invention relates to methods and systems for putting analysis.

There are numerous known devices for measuring putting parameters that determine the initial speed and direction of a putted ball. Such devices measure putter head speed and trajectory just prior to impact and the putter head position and orientation at impact. The most important orientation parameter at impact is the angle, the 'face angle', in the horizontal plane that the putter face makes relative to the intended line of putt. Devices incorporating laser beam pointers are available to help golfers align the face angle normal to the direct line between the initial ball position and the centre of a distant target; other devices are available that measure the face angle at address by electro-optical or other sensing means. However, in real putting situations, small slopes in the green or putting surface cause the ball to break from the direct line and instead follow a curved path, which in golfing terms is described as a 'breaking putt'. Thus, the optimum initial direction of a breaking putt is not along the direct line but is at an offset angle to it, so a device that points along the direct line is not useful unless there is some means of knowing this.

For breaking putts, the optimum offset angle is the angle between the direct line and the line midway between the minimum and maximum offset angles that achieve a successful putt. Also, with breaking putts, the ball can drop into the hole from slightly different directions depending on putt-strength so there is generally a significant range of possible offset angles. Judging the correct offset angle and putt strength for a breaking putt is one of the most difficult skills in putting. The surface gradient can change continuously in degree and direction so that predicting the optimum offset and putt strength from measured gradient data and 'green speed' (surface rolling-friction) data, if such data is available, is extremely complex and unreliable.

It is an object of the present invention to provide a method and system for putting analysis of improved form by which a golfer is provided more reliably and usefully with assistance for putting success.

According to one aspect of the invention there is provided a method for putting analysis comprising accumulating sets of historical data from respective putts of a ball towards a hole or other target of a putting surface, each set of data comprising data relating to the initial speed and direction of the ball as putted and the speed and direction of the ball in approaching the target together with representation of whether the putt was successful, deriving in relation to a golfer's putting stroke sensed signal-representations of resultant initial putted-ball speed and direction, determining from these representations and the sets of historical data whether that combination of initial speed and direction is consistent with achieving a successful putt on the putting surface, and providing indication dependent on the outcome of that determination.

According to another aspect of the invention there is provided a system for putting analysis comprising means for accumulating sets of historical data from respective putts of a ball towards a hole or other target of a putting surface, each set of data comprising data relating to the initial speed and direction of the ball as putted and the speed and direction of the ball in approaching the target together with representation of whether the putt was successful, sensor means for deriving in relation to a golfer's putting stroke signal representations of resultant initial putted-ball speed and direction, means for determining from these representations and the sets of historical data whether that combination of initial speed and direction is consistent with achieving a successful putt on the putting surface, and means for providing indication dependent on the outcome of that determination.

Each set of historical data accumulated in the method and system of the invention may involve measurements of both the impact parameters of the respective putt and the consequent direction, speed and rate of change of speed of the ball as it rolls near the hole or target. From these measurements, the ideal offset angle and putt strength for successful putts in the prevailing conditions can be computed and displayed.

The invention is applicable to real greens on practice areas or on actual golf courses but may also be used on artificial outdoor and indoor putting surfaces.

The success of a putt is dependent on the speed, the 'target-entry speed', of the ball at the instant it reaches the target. For the putt to be successful the ball must have sufficient final rolling speed to reach the target but if its target-entry speed is too high, the ball rolls over or 'lips round' the target. Target-entry speed may be estimated from measurements of the average speed of roll of the ball measured over a short distance in front of the target but preferably the estimate of target-entry speed is found from measurements of both the average speed and the rate of change of speed as the ball approaches the target. The rate of change of speed is normally deceleration due to rolling friction acting on the ball, but in some cases of downhill or severely-breaking putts the ball may actually accelerate as it approaches the target.

It is sometimes the case that there are opposing slopes along the general path of a putt so that balls break in different directions with different putts from the same starting point. It is then possible to have a 'miss-angle' zone or zones (where putts of any strength are unsuccessful) between two or more 'success-angle' zones. It is thus preferable that the method and system compute more than one break offset angle when these occur and sort them in order of dominance.

The target may comprise a standard hole sunk into the surface of a real putting green or into an artificial putting surface or it may comprise a target device resting on top of the putting surface. Such a target device may comprise a circular or otherwise shaped object that rests on the putting surface and is so shaped that a ball that would have rolled over or lipped round a regulation golf hole will also roll over or roll past the target device, whereas balls rolling at speeds that would successfully drop into a regulation golf hole will be retained in the target device. The regulation golf hole has a diameter of 4.25 inches (10.8 centimeters).

For given putting-surface characteristics (that is, slope geometry and surface friction), the parameters that determine a putt-outcome comprise the initial ball position relative to the target and the velocity, orientation and displacement of the putter-head relative to the ball at impact. Orientation parameters comprise the face angle, loft angle and lie angle at impact, whereas displacement parameters comprise the lateral and vertical offsets of the contact position of the ball on the putter face relative to the centre or 'sweet spot' of the putter face. In addition to the actual impact parameters, it is very advantageous to measure the orientation (especially the face-angle) and displacement parameters at address, before a putt is played. The method and system can then provide feedback to the player to correct the face-angle (and possibly other address parameters) before putting and also recommend optimum putt strength (for example, as a percentage of the previous putt played). If measurement of initial ball-position is not available, then the ball may be placed on the same initial spot each time and measurement limited only to putting-stroke parameters.

In addition to measuring the putting-stroke parameters and initial position of the ball, it is of great benefit also to measure the speed, direction and spin of the ball very shortly after impact, or at least a sub-set of these ball parameters. This capability provides a simple and reliable means of calibrating the measurement of the putter-head movement without elaborate setting up of sensors. It also provides a means of characterising the parameters of the putter itself (such as its rebound coefficient, the position of the putter-head sweet spot and the putt-length dependence on offset impacts). This in turn provides very useful feedback to the golfer to analyse his or her putting performance.

Various means may be adopted to sense the speed and direction of a ball as it approaches a target. For example a video camera may be used to record the ball as it rolls towards the hole and video analysis then used to compute the path and roll rate of the ball.

Alternatively, analysis of the output of electro-optical means which provides detection from a plurality of narrow beams of light radiated across the path of the ball, may be used. Detection in the latter case may be, for example, of light reflected from a standard golf ball (or possibly a ball with a retro-reflective surface) as it crosses each beam, or of the interruption of reflection from a retro-reflector as the ball passes between it and the light source. As a further alternative, one or more retro-reflectors may be provided on the surface of the ball, and if in these circumstances the light source and a reflection-detector are arranged coaxial with one another, or nearly so, a high coefficient of reflection can be obtained to give reliable detection even in the presence of high ambient light and extraneous reflections. In order further to reduce the effects of ambient light, the radiating beams may be modulated (for example, switched on and off) at a frequency of, for example, between a few hundred and a few thousand cycles per second, and detection carried out within a narrow band centred on the modulation frequency.

The one or more retro-reflectors may be provided as retro-reflective dots on the ball, and where more than one are provided they are preferably disposed in a spherically-symmetric arrangement as described in WO-A-2005/081014. In an exemplary embodiment, eight retro-reflective dots are provided at the centre of each facet of an octahedral dimple pattern and thus form the corners of a hypothetical cube inside the golf ball.

In one preferred embodiment of the present invention, six light beams are used, of which three parallel beams radiate across the expected path of a ball substantially at right angles to the ball-path so as enable measurements of the average speed and rate of change of speed of the approaching ball to be derived. The three further beams radiate at oblique angles to the expected ball path to provide additional data from which the direction and offset of the ball path relative to the target may be found and also whether or not the ball misses the target. It can be arranged that the ball cannot simultaneously pass through more than one beam from either of the two sets of three beams so the data can be reduced to two one-bit time-varying signals. Other arrangements of beams and different angles may be employed and the data may contain amplitude as well as time information.

Measurement of putting-impact and -address parameters may be made by electro-optical, electromagnetic, electro-acoustic, electromechanical or other means. However, if the initial position, velocity and spin vectors of the ball (or a sub-set of these parameters) are also measured, it is preferable to use means that is compatible with both requirements, for example by electro-optical means to sense reflections from the surface of the ball and parts of the putter, and/or light directly transmitted by light emitting devices attached to the putter.

Initial ball-position and ball-velocity vectors may be measured by sensing reflections from a standard golf ball but in order to measure spin it is necessary to mark the surface of the ball with a known, highly-contrasting reference mark or pattern that is easily detected by the sensing means. The reference mark or pattern may be provided using one or more retro-reflective elements. For example, a single dot may be used (for example, positioned prior to impact at the top-dead-centre of the ball) and the velocity and spin of the ball determined by sensing the different velocities of the ball as a whole and the dot.

However, in a preferred embodiment, a plurality of dots in a spherically-symmetric pattern as referred to above, are used. This has the advantage that it is not then necessary to position the ball with the dots in any prescribed orientation, prior to impact, since the spin vectors of the ball can be found by tracking the relative motion of two or more of the dots, and its velocity vectors can be measured by tracking the average motion of two or more of the dots. By discriminating between reflections from the retro-reflective dots and the cover material or 'substrate' of the ball, the ball-velocity vectors may instead be measured by tracking the substrate position, and although the substrate has low reflectivity relative to the retro-reflective dots, it does have significantly-higher reflectivity relative to typical putting surfaces and is thus easily detected by electro-optical sensors.

The system should preferably 'learn' the initial position of the ball accurately, and also, where retro-reflective markers are provided, their orientation on the ball. With this latter facility, the ball need not be placed on the same, exact spot for each putt, but may be placed anywhere within a defined area of the field of view of the electro-optical sensor arrangement.

Measurement of the putter position and orientation at address and during its forward swing and impact on the ball may also be implemented with retro-reflective dots or markers on the putter head and/or the putter shaft. Preferably, at least three markers are provided in a triangular arrangement as this provides the necessary reference marks to detect rotation about all three orthogonal axes of the putter-head. The positioning of the markers (for example, circular dots) can be chosen to optimise detection electro-optically. The markers may be in any orientation relative to the putter face with individual markers mounted solely on the putter head, solely on the putter shaft or mounted on both the head and the shaft. Preferably, the spacing and/or orientation of the markers on the putter are such that they are significantly different from the arrangement of retro-reflective dots on the golf ball so that the electro-optical sensor means can easily distinguish a reflective pattern associated with a golf ball from a pattern associated with a putter-head.

Although the pattern of reflective dots on golf balls used in the method and system of the invention should desirably be standard (but overall orientation prior to impact may be random), the pattern on a putter may preferably be variable within certain constraints. This allows for the fact that putter-heads come in a wide variety of shapes and sizes and it is impractical to set rules for the exact positioning of markers when these markers are arbitrarily attached to the putter-head by users of the method and system of the invention. It is thus an aim of the invention that the system 'learns' the positions of retro-reflectors on a putter relative to the pointing direction of the putter face and the sweet spot (that is to say, the impact point on the putter face that gives maximum launch velocity and zero imparted spin).

The face alignment and the sweet spot of the putter can be found from analysis of several measured outcomes. However, it is preferable that some rules are applied for placement of the reflectors. For example, the distance between the two most-separate dots or markers on a putter should preferably be greater than the diameter of a golf ball (for example, 50 millimeters or more) and two dots should preferably be aligned along the direction of the putter face. The retro-reflective markers may be accurately pre-positioned on the putter at manufacture, and where this applies to several putter-types, it may be arranged that the user of the method and system of the invention is then able to enter the data relevant to the putter type being used, merely by selection from a menu (on computer screen or otherwise) listing the applicable types.

Various means may be used to detect and track the position and motion of the retro-reflectors and the ball substrate. A frequently used method of capturing golf club and golf ball motion employs one or more high-speed video cameras with stroboscopic lighting. However, high-speed cameras are a high-cost solution and require a considerable amount of processing power to perform the video analysis. This is especially the case when two cameras are employed to give true three-dimensional measurements. The method and system of the invention, may as an alternative to this use linear sensor devices of the kind using a linear array of pixels (typically 64, 128, 256 or higher pixel count). These have the advantage of relatively low-cost and involve simpler data processing than is required for cameras which use two-dimensional pixel arrays, and although capable of high-speed operation, provide less image data than cameras. However, by arranging that the image to be sensed is of simple form (such as a white golf ball against a dark background or highly reflective, spaced-apart dots on the ball or putter), linear sensor devices can be deployed to capture all the necessary information required to implement the present invention. Optionally, a low-performance, low-cost video camera such as a 'webcam' can be used in addition to linear sensor devices to provide direct image information of the initial ball position and putter address set-up. If desired, a microphone may be provided to give confirmatory information on the instant of impact.

Each linear sensor device as referred to above, may be used in conjunction with a light aperture and cylindrical lens to focus external point-light sources into linear images in the plane of the linear array of pixels of the sensor device, so that with the axis of the cylinder at right angles to the array each pixel has a fan-shaped field of view. The total field of view for an N-pixel linear sensor device is the combination of N fan-shaped fields of view distributed angularly about an axis parallel to that of the cylindrical lens, to produce a solid angle of the same general shape as a camera field of view.

In order to detect the three-dimensional position of a single retro-reflective marker or dot, three spaced-apart linear sensor devices may be provided, each having a co-acting light source such as a light emitting diode (LED), located closely adjacent to the sensor device. Typically, the light source comprises a plurality of LEDs mounted as close as is practical to the periphery of the light aperture so that the 'observation angle' (namely the angle between the light source and a light-sensing pixel subtended at the retro-reflector) is as small as possible. This follows from the fact that the coefficient of retro-reflection is critically dependent on observation angle, with reflection coefficients at observation angles of 0.5 degrees or lower being orders of magnitude higher than at observation angles greater than 2.0 degrees. There are several observation angles associated with each linear sensor device since each has a plurality of light receptors (pixels) and a plurality of associated LEDs. It is an aim of the invention that for each pixel in a linear sensor the observation angle between that pixel and at least one of the available LEDs subtended at the golf ball is less than 0.6 degrees. In practice, this requires that the distance between any linear sensor and the golf ball is preferably more than 400 millimeters and more preferably more than 600 millimeters.

Preferably, the light sources associated with each linear sensor are switched on sequentially so that when (for example) three light sensors are used, each light source comprising a group of LEDs is switched on for one-third of the time sequentially, or alternatively for one-quarter of the time with all light sensors switched off for one-quarter of the sequence cycle. This helps to keep the power drain constant and modulates the received signal so that reflections from retro-reflected light can be distinguished from reflections from ambient light. Thus, during the period that a light source is switched off, its associated linear sensor receives reflections from ambient light, including light emitted from the other on-board but remote light sources when they are switched on.

Neglecting signal noise and random fluctuations in ambient light, the signal attributable to retro-reflected light only is the difference between the signal obtained during a 'light source on' quarter-cycle and an 'all light sources off' quarter-cycle. The ball substrate is preferably detected by reflections from ambient light only, which for each linear sensor is preferably the sum of signals obtained in the three quarter-cycles for which the light is switched off. For fast measurements, a two-phase cycle may be employed with all light sources on in one half-cycle and off in the alternate half-cycle but this is not quite as accurate as the four-phase arrangement because, for a given linear sensor, additional ambient light is emitted by the remote light sources that is not subtracted from its signal. To improve the contrast and detection of the ball substrate, the putting surface may be selected to have low reflectivity or may be treated with anti-reflection spray or the like.

Some measurements, such as the initial position and orientation of the golf ball, can be achieved at low sampling or frame rates, but it is preferable that the system is capable of very fast measurements during a short-duration period that includes the putter-on-ball impact. For most putts, the ball is airborne immediately after impact so its velocity and spin are constant for a short period before it touches down on the ground and can easily be measured with moderate speed means. However, if the putter face has negative loft at impact, the ball is immediately pushed into the putting surface at impact and in this case it is desirable to make very fast measurements (e.g. with sampling rates of up to 1 kilohertz or more) in order to distinguish between the effects of putter impact and ground bounce. Since high measurement speed generally requires high power consumption, means may be provided to store power during idle and low speed measurement phases to provide peak power surges for bursts of high-speed measurement. This minimises the peak input power requirement and conveniently allows operation from limited power sources such as a laptop computer Universal Serial Bus (USB) link. For low-speed, low-power phases of operation, the sampling period for each light sensor may advantageously be ½F where F is the local power distribution frequency (for example, 50 Hz in Europe and 60 Hz in North America). Since the linear sensor devices average the received light intensity over their sampling period, any ambient light modulation due to electric power light sources is averaged out to a constant level in successive samples.

The system is preferably provided with a graphical user interface (GUI) to enable users to operate the system with minimum set-up and learning requirements. Other information transmission means may be provided such as tactile (for example, with body mounted vibration or pressure actuators), or auditory (such as with a variable-pitch tone, variable-repetition tone, variable-loudness tone, or any combination of these). The information may be provided before the player makes a stroke (for example, information on the face-angle direction at address) or after the stroke is made (analysis of the putt outcome) or dynamically as the stroke is being made (for example, auditory or tactile sensation in synchronism with the optimum swing tempo, face-angle rotation or the like).

Optionally, other measurements may be made to augment the available information. For example, means comprising laser pointers or line-of-sight optics may be used to record the direction of the direct line between ball and target. The total time of travel from the initial putt impact (which may be detected by microphone or other means) to the point in time that a ball reaches the target may be recorded. Such measurements may be used to evaluate the putting surface itself as it provides a measure of the 'degree' of a break, and the effective 'green speed' for different putts. The consistency of putt direction and travel time measured over several putts gives a measure of the quality of the putting surface. The consistency measurement is especially sensitive for the area surrounding the hole or target as the ball rolls very slowly there and surface defects strongly affect the ball motion.

The system can provide means for checking that a practice putt (without a ball) has a high probability of success if the ball is struck with the same putter swing as in the practice putt. It is even possible for the system to compensate for slight differences in putter swing with, and without, the ball in place. However, Rule 14.3 of The Rules of Golf prohibits the use of "artificial devices or unusual equipment" that might assist a player in making a stroke or measuring playing conditions (such as gradients on the putting green). Thus, the present invention is intended primarily for training and practice purposes. For example, the system may be set up with two or more separate targets to provide putts of increasing difficulty, or artificial means may be provided to alter the contours of the putting surface so as to practice putts of varying difficulty from the same putting spot. Obviously, in the unlikely event that a future issue of The Rules of Golf does permit the use of equipment to check practice putts during a game of golf, then a form of system according to the present invention can be provided for this purpose.

The path that a ball takes to travel from its initial resting spot to a putting target is mainly determined by the contours and grain of the putting surface, but the path can also be affected by asymmetry in the ball. Thus, at impact, the dimples on the ball cover cause slight directional errors (as described in GB-A-2 364 651). Mass asymmetry in a ball generates gyroscopic precessional motion, which, combined with the linear rolling motion, causes the ball to move in a curved trajectory. This path curvature is particularly pronounced as the ball slows down. It is thus preferable that the method and system of the invention are used in conjunction with balls having low dimple-error characteristics (in the limit, balls with smooth spherical surfaces and/or very soft cover material) and low mass-asymmetry or with mass-asymmetry effects minimised by initial ball placement. Thus, it is desirable that the balls used in the method and with the system of the invention, are selected or manufactured to have very precise mass and geometric symmetry, or alternatively, are marked to show the point of mass symmetry.

Methods and systems in accordance with the present invention will now be described, by way of example, with reference to the accompanying drawings, in which:

FIG. 1 is a schematic representation in plan, and not to scale, of the system according to the invention;

FIGS. 2(*a*) to 2(*c*) are illustrative for the purpose of explanation of the manner of distribution of retro-reflective markers on a golf ball used in the system of FIG. 1;

FIG. 3 is a front view of a typical light-beam sensor used in the system of FIG. 1;

FIGS. 4(*a*) and 4(*b*) are sectional elevations of the sensor of FIG. 3, the section of FIG. 4(*a*) being taken on the line B-B of FIG. 3, and the section of FIG. 4(*b*) being taken on the line C-C of FIG. 3;

Figure 1:
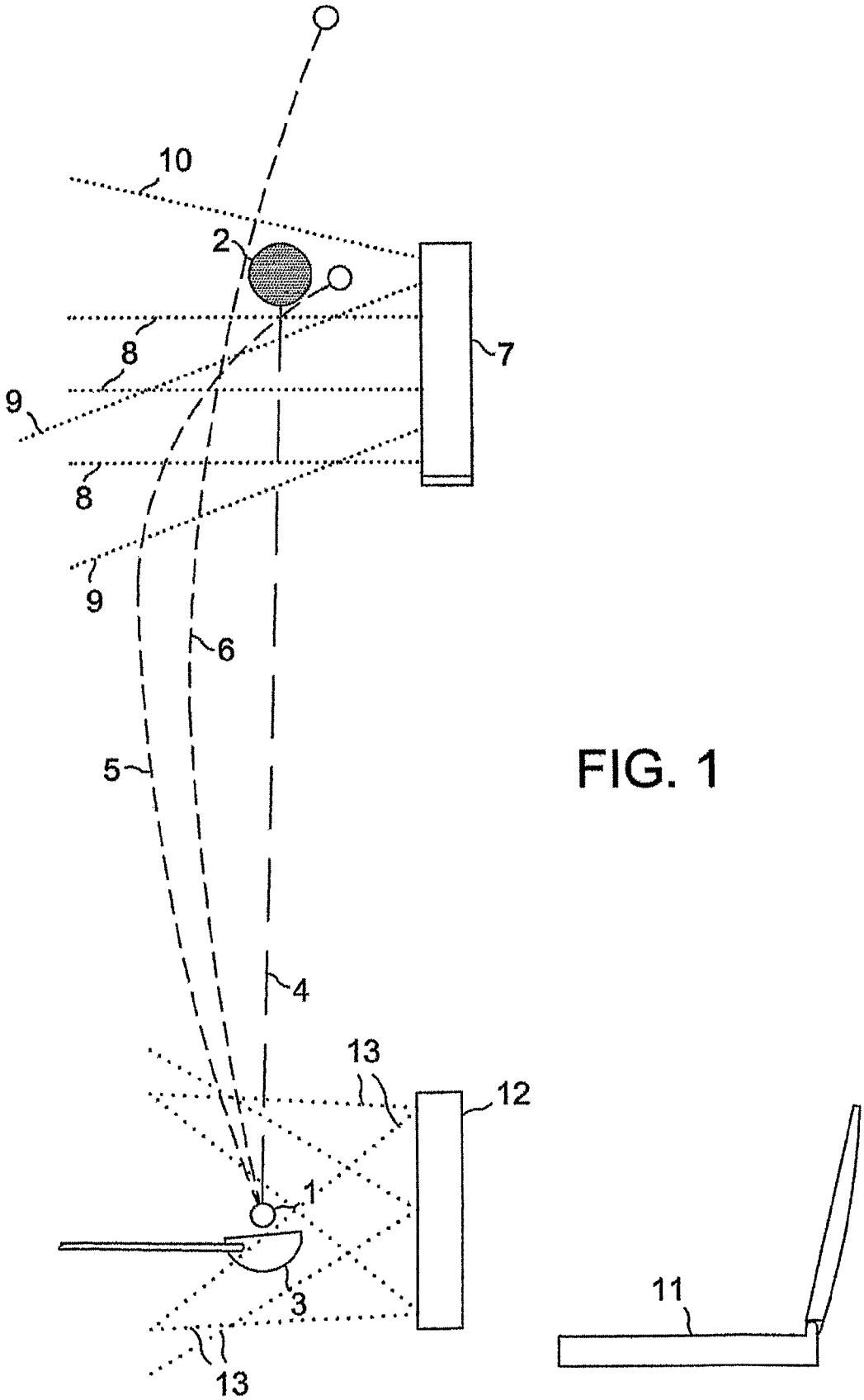
Figure 7A:
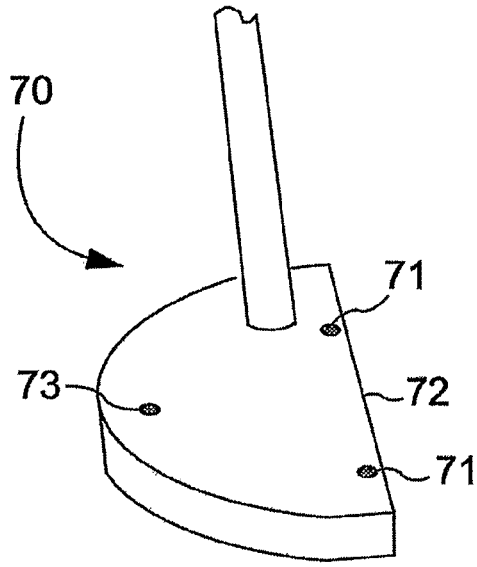
FIG. 7(*a*) is a perspective view from above of a form of putter used with the system of FIG. 1.
Figure 7B:
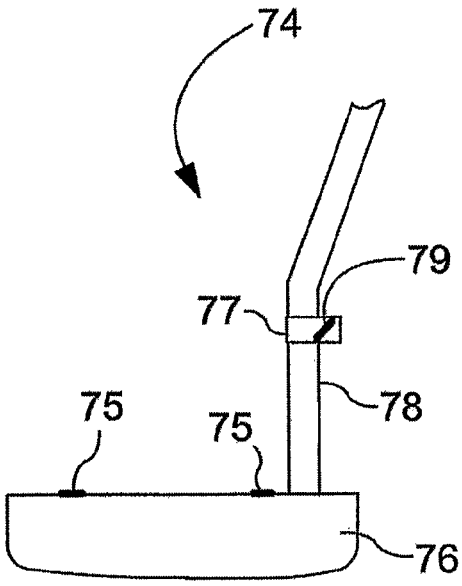
Figure 7C:
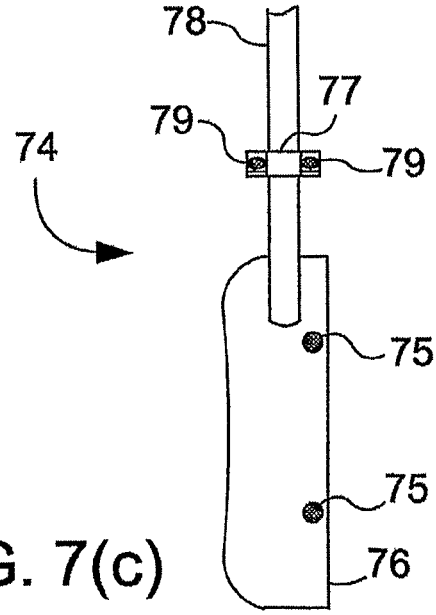
Figure 8A:
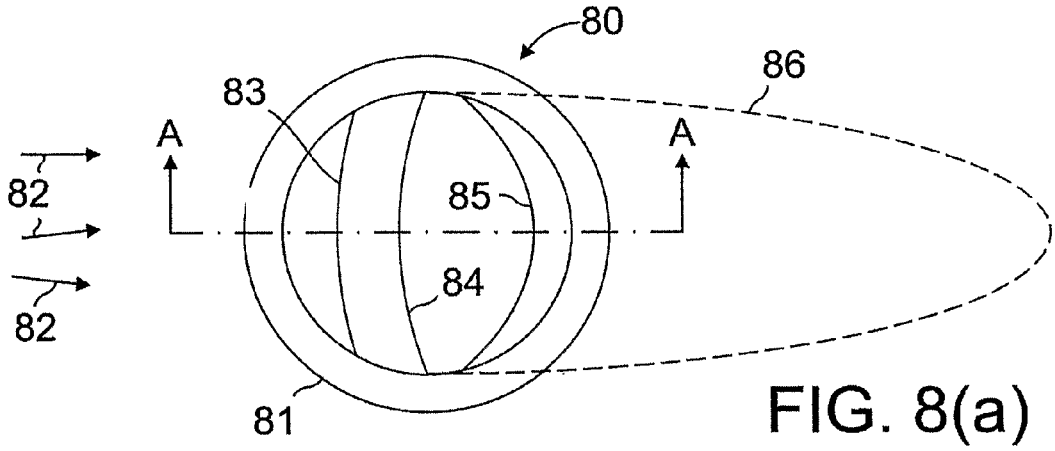
Figure 8B:
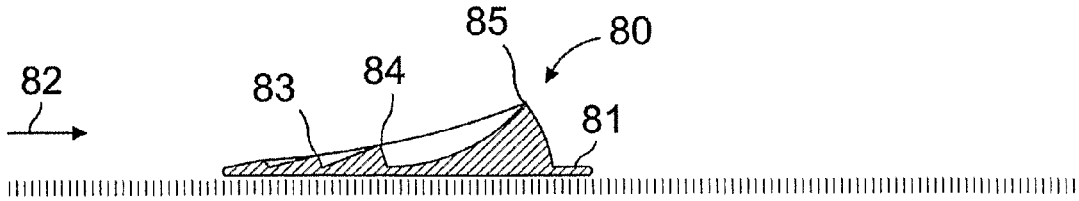

FIGS. 7(*b*) and 7(*c*) are front and plan views respectively of an alternative form of putter for use with the system of FIG. 1; and FIGS. 8(*a*) and 8(*b*) are plan and a sectional side-elevation of a target device that may be used with the system of FIG. 1.

Referring to FIG. 1, a golf ball 1 is shown at rest at some distance from a putting hole 2, prior to impact from a putter 3. A hypothetical direct line 4 between the ball 1 and the putting hole 2 indicates the ball-roll path that would obtain if the surface between the ball and hole was perfectly uniform, flat and horizontal. However, in this example it is assumed that the putting surface has a slight slope slanting downhill from left to right, so that in order to sink a putt the ball 1 must be directed uphill towards the left to roll downhill in approach to the hole. There is a narrow range of possible putts that will drop into the hole, so in order to sink a putt it is necessary to combine the correct strength of putt (which determines initial speed) with the correct line of putt offset at an angle from the direct line 4. The putt trajectories for two possible putts that just miss dropping into the hole 2 are shown at 5 and 6.

Trajectory 5 passes just to the right of the hole 2. This putt would have entered the hole opening if the ball 1 had been hit with slightly more strength along the same initial line of putt, but this would have brought with it the possibility of overrunning the hole 2 because ball-speed is critical in determining whether it drops in or jumps out. Trajectory 6, on the other hand, passes just to the left of the hole 2, and in this case the ball 1 would have dropped into the hole if it had been hit with slightly less strength along the same initial line of putt. However, if it had been hit with much less strength it would miss the hole 2 to the right, or fail altogether to reach it.

Thus, there is a myriad of possible combinations of putt strength and direction to sink breaking putts, and an object of the system of the invention is to measure and analyse how putts approach the hole, and from that estimate the initial direction and strength of putt that has the best chance of successfully dropping into the hole. Putts that just miss the hole and putts that drop into it provide equally useful data for this estimation process. As more putt-outcomes are measured, the system improves its estimate of optimum initial-putt conditions such as offset angle relative to the direct line 4 and putt strength. This estimate is fed back to the player so that he or she can practise successfully and learn how breaking putts travel.

In fulfilling this object, the system measures the speed and direction of the ball 1 as it leaves the putter 3 and as it approaches the hole 2 and also measures the time lapse between the impact of the putter 3 and the ball 1 reaching the hole 2. From this, an approximate estimate of the length of the putt can be made using the following equation:

$$L = \frac{1}{2} \times \left[\frac{5}{7} \times V_0 \times \left(1 + \frac{2}{5} \times R\right)\right] \times t \quad (1)$$

Where L is the length of the putt, $V_0$ is the initial ball velocity as it comes off the putter face, R is a parameter called the spin rate and t is the lapsed time between the putter impact and the ball reaching the hole or target. The parameter R is the ratio of the ball's peripheral speed due to spin to its linear velocity and is positive for topspin and negative for backspin. If means for measuring the ball spin are not available, the value of R can be assumed to be zero, which is reasonably accurate for most putts. When R is zero, equation (1) reduces to:

$$L = \frac{1}{2} \times \left(\frac{5}{7} \times V_0\right) \times t \quad (2)$$

It is well known that after a golf ball leaves the putter face it generally has only linear velocity and must first skid along the surface and thereby lose linear momentum and gain rotational momentum. Its speed after skidding reduces to 5/7ths of its initial speed. Equations (1) and (2) assume that the deceleration when the ball is rolling is constant (which is a nearly the case for flat surfaces) so that ball-velocity decreases linearly with time and thus the average velocity during rolling is half the initial rolling velocity. Equations (1) and (2) neglect the initial ball skid that is characteristic of putts and assumes that the ball stops fairly near the hole or target and that the putting surface is flat and uniform (but not necessarily horizontal).

Although the estimate of putt length may be 30% in error or worse, it is only required to provide a reasonable approximation of the putt length for the purpose of initial feedback when there is no history of previous putts. Thus, if the first ball rolls fractionally past the right of the hole at terminal speed as shown in trajectory 5 of FIG. 1 and the estimate of putt length is 280 centimeters, then the system will assume that the line error of about 5 centimeters (half the diameter of the hole) requires a putter face adjustment of 1.0 degree more closed (for a right-handed golfer) at impact (since arctan (5/280) equals 1.0 degree). Moreover, the system can compute that, for the green-speed conditions pertaining, a 16% longer putt length (say) would have a higher probability of success, and thus that an 8% faster putter swing at impact is required (since the putt distance is proportional to the square of putter-head impact speed). The green-speed can be very accurately measured from measurements of rate of change of ball velocity as it approaches the hole.

The first putt measured by the system provides the first entry in a 'putt history databank' that is stored in computer memory. The second putt may follow the path of trajectory 6 in FIG. 1, missing the hole 2 to the left and rolling well past it. To a first approximation, the difference in ball-approach speeds at the hole is proportional to the difference in putter-head speeds at impact, and similarly, the difference in ball-approach offset at the hole is proportional to the difference in putter-face alignment at impact. From such a putt, the system acquires data that accurately relates the putter-head speed to the ball-approach speed at or near the hole, and the putter-face alignment to the degree of line error. Further putts provide more putt-history data so that the system very quickly learns the optimum line and length required to sink putts in the given scenario. For teaching purposes, one measurement system can be permanently set up on an indoor artificial putting surface to 'learn' the optimum line and length of several putts of gradually increasing difficulty, with the most difficult putts being furthest away from the initial ball position. When putting to a distant hole, the holes at shorter distances can be capped so that they provide a virtually uniform rolling surface and visually blend into the putting surface.

The data required for accurately determining the characteristics of a given target and initial ball position is dependent on factors such as the range and complexity of slope variations along the putt line. Thus, the characteristics of a short putt on a flat, horizontal surface can be found very accurately with only three or four putts, whereas more difficult putts need at least ten, and possibly twenty or more, putts to 'learn' their characteristics. Thus, it is very advantageous when the means for measuring the ball-approach speed and direction at a target or hole, is easily portable and can be removed from a target once the characteristics for that target are accurately determined. This is cost-effective since only one sub-system is required to measure ball-approach at a plurality of targets. It is also less invasive than a permanent sub-system, since it is only required temporarily at a target and can be subsequently removed so that it does not interfere with play.

There are various ways of providing feedback to a golfer using the system. For example, the system can measure the putter face angle at address while the head is static and indicate an open or closed error from the ideal, which the golfer then nulls by appropriate rotation of the putter face. The optimum putt strength can be indicated based on the immediately previous putt (for example, 8% more speed required).

One very useful method of providing feedback is to measure and analyse a golfer's practice putt without a golf ball immediately prior to attempting a putt with a ball. The Rules of Golf permits golfers to make practice swings before making a proper stroke so on the putting green it is very useful to visualize a putt by swinging the putter as if making a stroke but taking care not to hit the ball. The system can guide the golfer to perform a nearly-perfect practice swing before making a putting stroke and from this develop a routine of successfully sinking 'virtual putts' just prior to attempting the real stroke. In some cases, there may be consistent differences between a player's practice swings and actual strokes, which it is very desirable to quantify. For example, players who suffer from the 'yips' (i.e. a tendency to twitch during the putting stroke) may find practice on the system with virtual putts revealing and helpful.

Useful statistical data can be built up about a player, so that areas of weakness that might be very difficult to observe directly can be identified. Statistical analysis can be used to identify what putter weight and set-up gives the best performance for any particular player.

Moreover, such analysis can reveal a great deal about the comparative performance of different putter designs.

Measurement of the speed and direction of the ball 1 as it approaches the hole 2 is provided by a target approach monitor 7. The monitor 7 generates three parallel light beams 8 that cross the expected path of the ball 1 in front of the hole 2 at right angles to the direct line 4, and two oblique light beams 9 that also cross the expected path of the ball 1 in front of the hole 2. A further beam 10 detects balls that miss the hole. Other arrangements of light beams can be adopted.

Figure 2A:
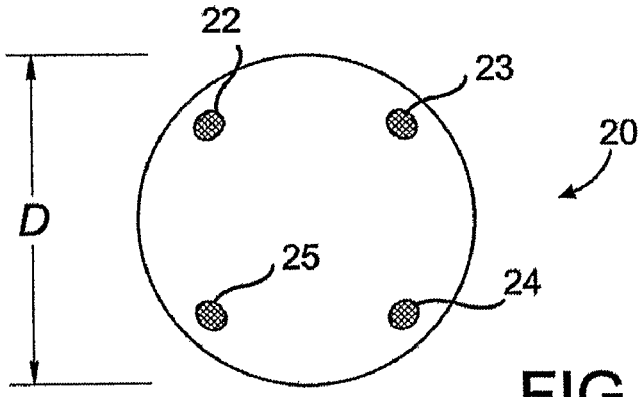
Figure 2B:
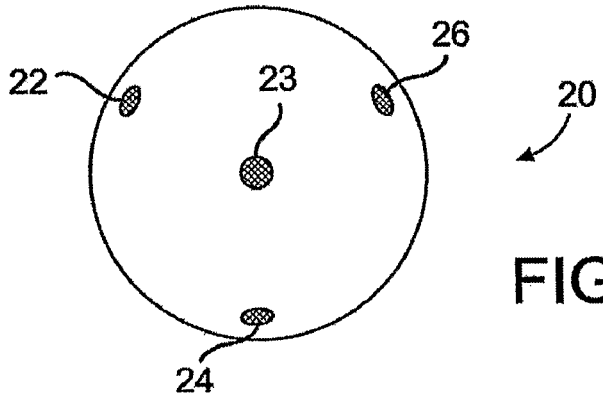
Figure 2C:
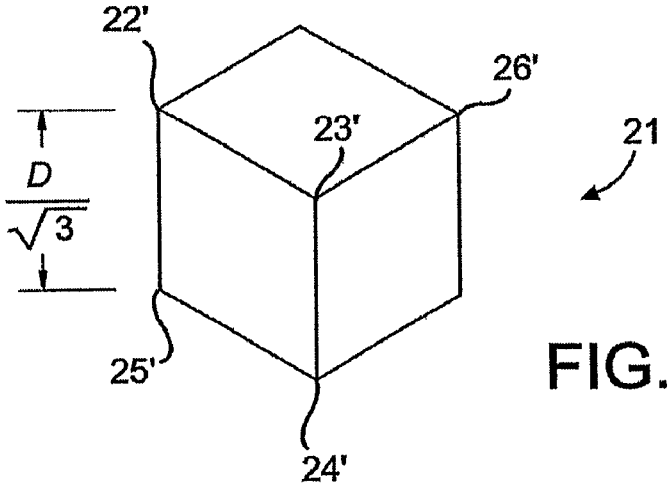

The monitor 7 detects reflections from the ball 1 as it crosses through the beams 8 and 9 for successfully 'holed' putts, and also as it crosses the beam 10 for missed putts that roll beyond the hole. The ball 1 may be a standard golf ball but preferably is a special ball with a spherically symmetric arrangement of retro-reflective dots. One typical arrangement of retro-reflective dots is illustrated and will be described with reference to FIGS. 2(*a*) to 2(*c*), where a golf ball 20 has dimples (not shown) arranged in an octahedral distribution. The octahedral distribution of dimples is well known in golf ball design and comprises eight identical quasi-triangular facets on the surface of a ball, with individual dimples being distributed tri-symmetrically about the centre of each facet, and in this case the surface of the golf ball 20 has a retro-reflective dot positioned in the centre of each of the eight facets of the octahedral pattern. The centres of the eight dots are thus located at the corners of a hypothetical cube 21 shown in FIG. 2(*c*), with, as shown in FIG. 2(*a*), four dots 22, 23, 24 and 25 corresponding to corners 22', 23', 24' and 25' respectively of the cube 21, and, as shown in FIG. 2(*b*), four dots 22, 23, 24 and 26 corresponding its corners 22', 23', 24' and 26'. Each side of the hypothetical cube 21 has a length equal to the ball diameter D divided by $\sqrt{3}$.

A disadvantage of using retro-reflective dots on the ball surface is that, in general, the dots do not cross the beam paths at the same speed as the centre of the ball, since the dots rotate about the roll axis of the ball. By arranging that the parallel, spaced beams 8 are separated by a distance equal to the ball-circumference C, or integral multiples of it, the positions of the dots relative to the ball-centre will be the same at each beam, so measurement of ball-speed and rate of change of speed is very accurate even when the ball deviates by up to ±10 degrees from perpendicular to the beams. C is never less than 134 millimeters, and usually not greater than 136 millimeters, for most types of golf ball conforming to The Rules of Golf.

Similarly, for the oblique beams 9, the distance between the beams measured along the direct line direction is C, or an integral multiple of it. However, small errors remain in the measurement of direction (but not offset) since the path lengths between beams are no longer C when the ball path is not parallel to the direct line. If required, these small errors can be reduced by weighted averaging as between measurements derived from two or more reflective dots and/or by the provision of additional beams with reversed obliqueness angles.

As the ball 1 is detected passing through the three beams 8, its average speed and rate of change of speed can be computed and from this its true speed as it enters, or just passes, the hole 2 can be accurately estimated. This also gives a measure of the effective green-speed local to the hole (which will be dependent on any slope); a measure of overall green-speed is obtained from measurements of the time taken for the ball 1 to travel from its initial spot to the hole 2, and the distance to the hole 2.

Typically, the signal output from each sensor channel is a logical one, '1', (for ball presence) or zero, '0', (for ball absence). Since the ball 1 is never simultaneously present in any two of the three beams 8, the logic signals can be combined (for example by means of an OR gate) to provide a single signal representative by a sequence of ones and zeros of passage of the ball (or its retro-reflector) through the three beams 8 in turn.

Signals representing the presence or absence of the ball 1 as it passes through the two oblique beams 9 and the 'back-of-hole' beam 10 can be similarly combined into one logic-signal sequence. This and the sequence derived by the three beams 8, give data representing the speed and direction of the ball relative to the hole 2 and the direct line 4 and also confirm whether or not the ball successfully dropped into the hole. However, it may be preferable to implement two-channel signal amplitude data capture for more sophisticated processing.

The target approach monitor 7 is designed to be compact and very unobtrusive and is typically only 20 millimeter or so high. The end of the monitor 7 facing the putter may be lofted so that a ball does not bump the monitor (which might slightly shift its position), but instead rolls up the lofted end and rolls off.

Data from the target-approach monitor 7 is transmitted to the computer 11 either via an interface cable such as a USB link (not shown) but more preferably by a short range wireless link such as an RF or infrared link. The computer 11, which is typically a battery-powered laptop computer or the like, communicates with a putting analyser 12 located near the spot from which putting takes place. The analyser 12 derives measurements of various static and dynamic parameters of the head of the putter 3 including its instantaneous orientation and position when at rest or moving, using light beams 13 directed across the region of the putting spot for retro-reflection from the putter 3. These measurements provide the data to predict the velocity and spin imparted to the ball 1 at impact. The putting analyser 12 preferably also measures at least the initial ball position but also the velocity (speed and direction) of the ball immediately after impact, and most preferably the initial position, the velocity and the spin vectors (spin rate and spin axis tilt) of the ball 1. These additional measurements provide the system with significant capabilities and user-convenience including reliable means of self-calibration and the ability to characterise the parameters of the putter itself (such as its rebound coefficient, the position of the putter-head sweet spot and the putt-length dependence on offset impacts).

The putting analyser 12 typically interfaces the computer 11 via a USB link (not shown) that also provides operating power. Alternatively, the putting analyser 12 may be powered from an internal battery supply and communicate to the computer 11 via a wireless link. The putting analyser 12 is active for much more of the system operating time than the target approach monitor 7, so battery replacement in the putting analyser 12 is likely to be frequent. The target approach monitor 7 needs to be active for only 2 to 3 seconds each time a putt is struck, since the computer 11 can predict when the ball will roll into its field of view. Thus, battery power in the target-approach monitor 7 can be minimal and it is thus practical to operate from battery power and communicate with a wireless link.

Each of the sensors used in the putting analyser 12 is of the form illustrated in FIGS. 3 and 4(*a*) and (*b*), and will now be described.

Figure 3:
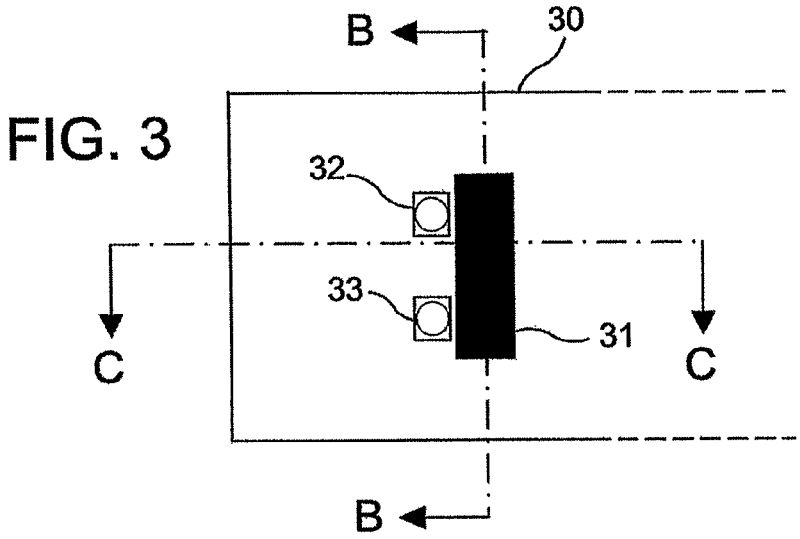

Referring initially to FIG. 3, the front face of the housing 30 of the sensor involves an elongate, rectangular aperture 31 which incorporates a filter that is transparent to infrared light but blocks visible light. Two infrared LEDs 32 and 33 are mounted spaced apart on the outside of the housing 30 close to one of the longer edges of the aperture 30; operation at near infrared (wavelength of 800 nanometer to 950 nanometer is preferred, but other light spectra may be used). The location of the LEDs 32 and 33 close to the aperture 31 ensures that there is no local path for the light emitted by them to enter the housing 30 other than from reflection; this is important for avoiding swamping of the reflected beams.

Figure 4A:
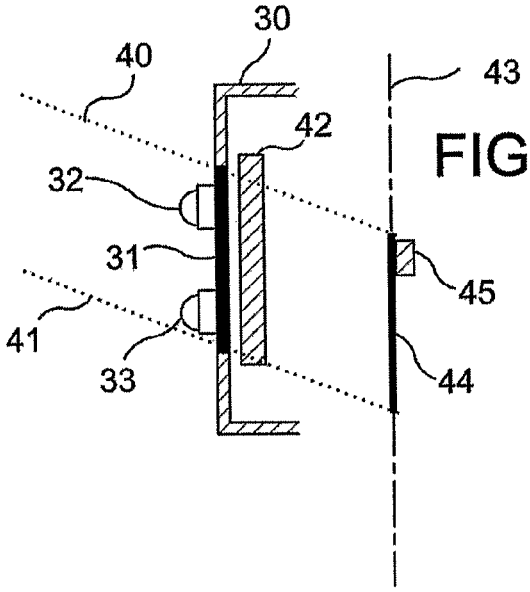
Figure 4B:
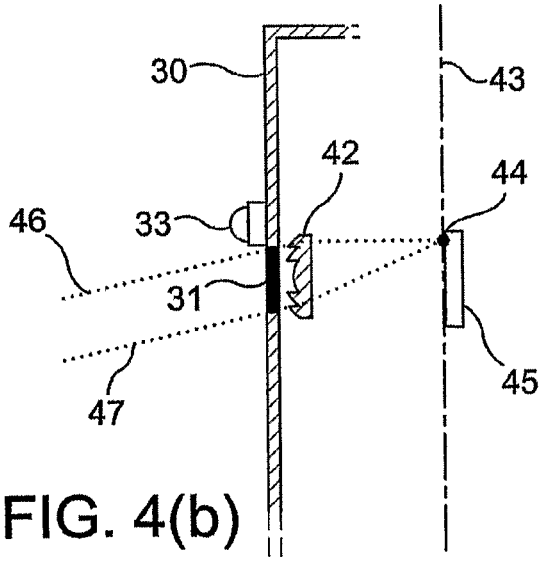

FIG. 4(*a*) shows a section in the plane B-B of FIG. 3, with the boundaries of a light beam received at an extreme angle from a distance source in that plane represented by dotted lines 40 and 41. Received beams pass through a cylindrical lens 42 and are focussed in a plane 43 normal to the plane B-B to form a line focus 44; the light is not bent (neglecting lens thickness) as it passes through the lens. Part of the line focus 44 is at, or very near, the sensitive surface of a linear sensor device 45, and if the distant source giving rise to the beam represented by the dotted lines 40 and 41 were to move further upwards in the plane B-B, the line focus 44 would shift downwards and light from the distant source would not reach the linear sensor device 45. Thus, the height dimensions of the aperture 31 and the distance of the focal plane behind the aperture 31 determine the angular field of view of the sensing device 45 in the plane B-B.

In the case of the section in plane C-C shown in FIG. 4(*b*), dotted lines 46 and 47 represent the boundaries of a light beam from a distant source received at an extreme angle in that plane. The light in this plane is bent by the cylindrical lens 42 and the line focus 44 is end-on, at right angles to the plane C-C. Here the length dimensions of the linear sensor device 45 and the distance of the focal plane 43 behind the aperture 31 determine the angular field of view of the device 45 in the plane C-C, and consequently the extent of scan provided by the sensor via the aperture 31.

The cylindrical lens 42 is represented in FIG. 4(*b*) as a coarse-faceted Fresnel lens. Micro-machined plastic Fresnel lenses with very fine facet-spacing and aberration correction are available at low cost, and are a preferred component, but two-surface lenses may be used instead.

Each LED 32 and 33 is typically a surface-mounted device with 'TOPLED' type package (having approximately 3 millimeters-square footprint) or other very small dimension package and preferably includes small, surface-emitting chips and integral lens. This configuration allows all the LED emissions to emanate from a point only 1.5 to 2.0 millimeters from the edge of the aperture 31. Furthermore, the observation angle subtended between any pixel of the linear sensor device 45 and any LED 32,33 can be arranged to be less than 0.6 degrees by limiting the value of S/G to be no more than 0.01, where S is the maximum distance of any light ray entering the aperture 31 from an adjacent LED 32, 33, and G is the distance from the relevant reflected-light source (for example, the golf ball); this can be achieved by limiting the width of the aperture 31 and providing the two (or more) LEDs close to the aperture-edge. However, it may be preferable in some situations to allow twice this value of observation angle, since limiting the observation angle in the manner described provides very high contrast between retro-reflective surfaces and the unwanted background reflections. If necessary, highly polished putter heads can be lightly sprayed with an anti-reflection coating prior to attachment of retro-reflective markers. In this respect, however, special putters can be provided with guaranteed non-reflective properties and optimally mounted retro-reflectors. Advantageously, any such special putter will have precisely-known retro-reflective positions in relation to the sweet-spot of the putter-head and a face-angle that can be memorised by the system for quick and accurate self-calibration.

Figure 5:
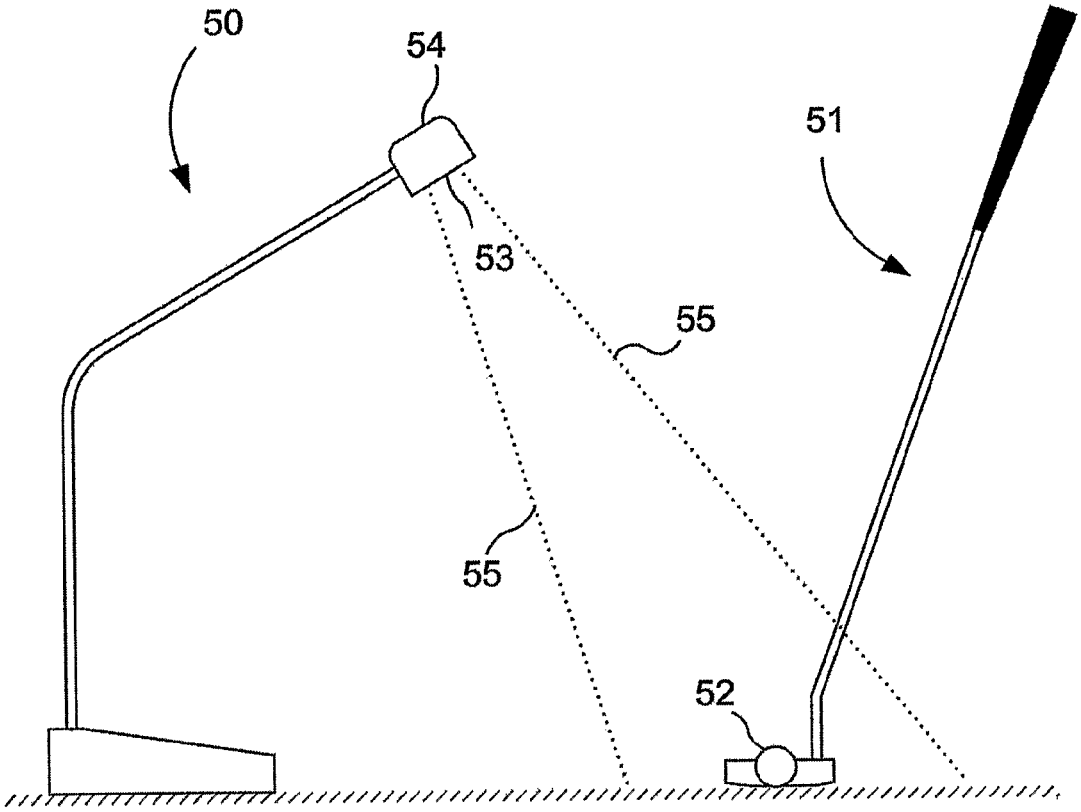
FIG. 5 is illustrative in side view of a putting analyser of the system of FIG. 1, as located at a putting position.

A schematic view of a putting analyser 50 that may form the analyser 12 of FIG. 1 is shown in FIG. 5, with a putter 51 and ball 52 at their address positions. The front face 53 of the sensor housing 54 in this case is directed downwardly towards the golf ball 52 at an angle of approximately 30 degrees to the vertical. Dotted lines 55 indicate the field of view of the analyser 50 extending several centimeters (for example, at least 10 centimeters) forward of the toe of the putter 51 and backwards from its heel. In a similar manner, the field of view into and out of the plane of the drawing extends several centimeters (for example, at least 10 centimeters) in front of and behind the ball 52. The front face 53 of the sensor housing 54 is at least 40 centimeters, but preferably 80 centimeters or more, above the ball 52 so as to minimise the observation angle, and the downward field of view ensures that there is a static background to what is 'seen' by the analyser 50.

Figure 6:
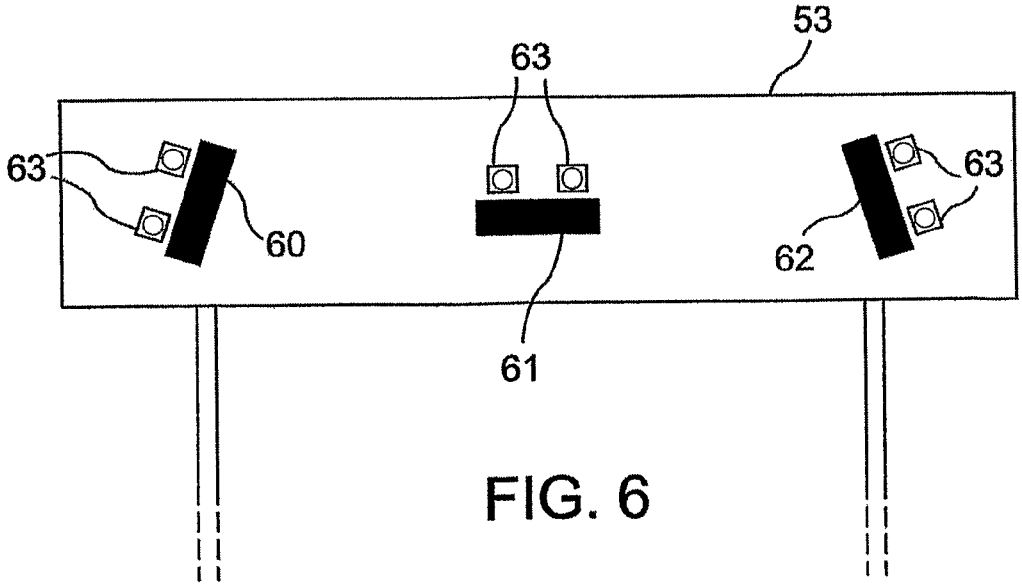
FIG. 6 is an enlarged view of the front face of the putting analyser of FIG. 5.

The front face 53 of the analyser 50, which is shown face-on and not to scale in FIG. 6, incorporates three sensors of the form described with reference to FIGS. 3 and 4(*a*) and (*b*), having apertures 60 to 62 respectively for receiving reflected infrared light. The infrared light in each case is emitted from a pair of LEDs 63 located very close to a longitudinal edge of the respective aperture 60 to 62. The analyser 50 is oriented with the aperture 61 horizontal and generally at right angles to the heel-toe axis of the putter 52 so that the scanning by its linear sensor device is in the heel-toe direction. The two apertures 60 and 62 are oppositely inclined to the aperture 61 such that their linear sensor devices scan roughly front-to-back of the putter-head with opposite inclinations of at least 5 degrees (typically 10 degrees) from alignment with the front-to-back direction. The opposite inclination of the apertures 60 and 62 from right angles to the aperture 61 ensures that when the putter-head is correctly aligned, markers on the putter-head are not simultaneously detected by the linear sensor devices of the two apertures 60 and 62.

The described arrangement of the apertures 60 to 62 of the three sensors of the analyser 50, ensures that markers on the putter can be detected from three different angles and positions and their position in three-dimensions ascertained. This in turn allows accurate tracking of the putter head in all six degrees of freedom.

Examples of putter-heads with attached retro-reflective markers will now be described with reference to FIGS. 7(*a*) to (*c*).

Referring to FIG. 7(*a*), a mallet-type head 70 of the first example of putter, has two retro-reflective dots 71 on its upper surface that are aligned at least approximately with the impact face 72, and a third retro-reflective dot 73 attached near the back of the upper surface so as to define with the dots 71 a substantially horizontal triangle on the putter-head 70.

The second example of putter is illustrated by FIGS. 7(*b*) and 7(*c*) and has a blade-style head 74 that is provided with two retro-reflective dots 75 on its upper surface which are at least approximately aligned with the impact face 76 of the head 74. A clip 77 attached to the putter-shaft 78 slightly above the head 74 is provided with two retro-reflective dots 79 located either side of the shaft 78 and at a precisely-known distance apart. In this case, the dots 75 define with each dot 79 a substantially vertical triangle, the two triangles being defined on opposite sides of the shaft 78 for sensing by the sensors 60 and 62 respectively (the sensing of different triangles by the sensors 60 and 62 allows for the fact that the shaft 78 obscures a respective one of the dots 79 from being sensed by each sensor 60 and 62).

The ball 52 too, when provided with appropriate retro-reflective dots as described above with reference to FIGS. 2(*a*) and (*b*), is tracked by the analyser 50 so that all its velocity and spin vectors are determined. There is a random chance that two dots will sometimes align with a fan-beam of one sensor but not simultaneously with fan-beams of the other two sensors. Thus, the movement of retro-reflective dots on the ball 52 can be completely determined.

The full system as described above provides comprehensive data on the outcome of putts in real putting conditions and the reasons for these outcomes. However, the putting analyser 12 and the target approach monitor 7 may be used as stand-alone systems if preferred and may each be provided with an in-built user interface instead of utilising a lap-top or other personal computer.

Furthermore, the system, rather than being used in the context of a putting green with a target hole, may be used elsewhere utilising a target device as illustrated in FIGS. 8(*a*) and (*b*), instead of the hole.

Referring to FIGS. 8 (*a*) and (*b*), the target device 80 has an outer rim 81 which is very low compared to the diameter of a golf ball but strong and rigid to withstand everyday use without distorting. A ball approaches the target device 80 along various paths indicated by arrows 82, and the target device 80 is so shaped that for any of a range of approach paths 82 the ball will roll onto it and be retained on it, provided that the speed of target entry is below a critical value for the approach path.

A ball that travels down the centre-line of the target device 80 at just below the critical target-entry speed will roll over intermediate projections 83 and 84 and then up to a high projection 85 but will not roll over it. Instead the ball will fall back and be retained in the target device 80. However, if the rolling speed of the ball exceeds the critical target-entry speed it will climb up the high projection 85 and roll off the device 80. Balls that travel at lower than the target-entry speed simply lip over the inner edge of the outer rim 21 and are retained. The contours and heights of the projections 23 to 25 are designed so to create a 'capture zone' that is closely equivalent to the 'sink zone' of a regulation golf hole.

A full description of the sink zone for golf putting is given in Tierney, D. E. and Coop, R. H. 1999. *A Bivariate Probability Model for Putting Proficiency*, In Science and Golf III, ed. A. J. Cochran and M. R. Farrally, 385-394, United Kingdom Human Kinetics. The contour of the sink zone is shown in dotted outline 86 in FIG. 8(*a*). All balls that would have dropped into a regulation golf hole would theoretically come to rest within this zone 86 if the hole is replaced with a flat putting surface. Balls that enter but roll beyond the sink zone 86 would theoretically hop out of the hole (if such existed). Various means including flexible and frictional elements may be employed to achieve matching of the capture zone 86 of the target device 80 with the ideal regulation golf-hole sink zone.

The system may be provided with a two-axis tilt sensor that measures the orientation of the analyser 50 relative to the horizontal. This provides the degree and direction of any small inclination of the analyser 50 about the horizontal. The inclination measurements are included in the putt-measurement calculations, and remove the necessity for carefully levelling the analyser 50 before making putts. The actual putting surface inclination may be different from that of the analyser 50 but the local ground plane slope can be measured from accurate measurements of three or more different ball-positions prior to making putts.

The invention claimed is:

1. A method for putting analysis using sensors comprising accumulating a plurality of sets of historical data from respective putts of a ball towards a target of a putting surface, each set of data comprising measurements relating to the initial speed and direction of the ball as putted and measurements relating to the target-approach speed and target-approach direction of the ball in approaching the target together with representation of outcome of the putt, deriving in relation to a golfer's putting stroke signal-representations of resultant initial putted-ball speed and direction, providing an analysis-result by determining from the signal-representations of resultant initial putted-ball speed and direction and the sets of historical data an estimate of the initial putted-ball speed and direction which in combination are most consistent with achieving a successful putt on the putting surface, and providing indication dependent on the analysis-result, wherein the estimate of initial putted-ball speed and direction is derived in dependence upon the measurements relating to the target-approach speed and target-approach direction together with the outcome of each of a plurality of the sets of historical data.

2. The method according to claim 1, further comprising the step of deriving the signal-representations of resultant initial putted-ball speed and direction from sensing the initial speed and direction of a ball putted by the golfer in the putting stroke.

3. The method according to claim 1, further comprising the step of deriving the signal-representations of resultant initial putted-ball speed and direction from sensing velocity and spin of the ball.

4. The method according to claim 1, further comprising the step of deriving the signal-representations of resultant initial putted-ball speed and direction as a prediction from sensing speed and orientation of a putter used by the golfer in the putting stroke.

5. The method according to claim 1, further comprising the step of deriving the signal-representations of resultant initial putted-ball speed and direction as a prediction from sensing velocity, orientation and displacement relative to the ball of a putter-head used by the golfer in the putting stroke.

6. The method according to claim 1, wherein the indication dependent on the analysis-result includes information indicative of correction of at least one of putter-speed and putter-orientation required to achieve a successful putt on the putting surface.

7. The method according to claim 1, further comprising the step of acquiring the accumulated sets of historical data from respective putts made from the same location towards the target of the putting surface.

8. The method according to claim 1, wherein each set of historical data accumulated includes measurements dependent on both the impact parameters of the putter head in the respective putt and the consequent direction, speed and rate of change of speed of the ball as it rolls near the target.

9. The method according to claim 1, wherein the indication dependent on the analysis-result includes information indicative in relation to the golfer's putting stroke of correction of at least one of putter-speed and putter-orientation required to achieve a successful putt on the putting surface.

10. The method according to claim 1, wherein the indication dependent on the analysis-result includes representations of putt strength and an ideal offset angle from a straight line to the target for a successful putt.

11. The method according to claim 1, further comprising the step of using a hole of the putting surface as the target.

12. A system for putting analysis comprising monitor means for responding to a ball putted to approach a target of a putting surface, the monitor means providing signals related to target-approach speed and target-approach direction of the ball, means responsive to the signals provided by the monitor means for accumulating a plurality of sets of historical data from respective putts of a ball towards the target of the putting surface, each set of data comprising data relating to the initial speed and direction of the ball as putted and measurements relating to the target-approach speed and target-approach direction of the ball in approaching the target together with representation of outcome of the putt, sensor means for deriving in relation to a golfer's putting stroke signal-representations of resultant initial putted-ball speed and direction, means for providing an analysis-result from the signal-representations of resultant initial putted-ball speed and direction and the sets of historical data an estimate of the initial putted-ball speed and direction which in combination are most consistent with achieving a successful putt on the putting surface, and means for providing indication dependent on the analysis-result, wherein the means for providing the analysis-result includes means for deriving the estimate of initial putted-ball speed and direction in dependence upon the measurements relating to the target-approach speed and target-approach direction together with the outcome of each of a plurality of the sets of historical data.

13. The system according to claim 12, wherein the indication dependent on the analysis-result includes information indicative in relation to the golfer's putting stroke of correction of at least one of putter-speed and putter-orientation required to achieve a successful putt on the putting surface.

14. The system according to claim 12, wherein the indication dependent on the analysis-result includes representations of putt strength and an ideal offset angle from a straight line to the target for a successful putt on the putting surface.

15. The system according to claim 12, wherein the sensor means for deriving the signal-representations is electro-optical sensor means.

16. The system according to claim 12, wherein the monitor means includes sensor means located adjacent the target for deriving signal-representations dependent on the speed and rate of change of speed of a putted ball in its approach to the target.

17. The system according to claim 16, wherein the sensor means located adjacent the target is electro-optical sensor means.

18. The system according to claim 12, wherein the monitor means includes sensor means located adjacent the target for deriving signal-representations dependent on the direction and offset angle from a straight line to the target of a putted ball in its approach to the target.

19. The system according to claim 18, wherein the sensor means located adjacent the target is electro-optical sensor means.

20. The system according to claim 12, wherein the target is a hole in the putting surface.

* * * * *